United States Patent [19]

Bolcavage et al.

[11] 4,317,412

[45] Mar. 2, 1982

[54] CONTROL SYSTEM AND METHOD FOR TESTING PRINT HAMMERS IN A HIGH SPEED PRINTER

[75] Inventors: Richard D. Bolcavage, Kirkwood; Michael D. Hryck, Endwell; William B. Kauczka, Endicott; Harold B. Kinter, Binghamton, all of N.Y.

[73] Assignee: International Business Machines Corporation, Armonk, N.Y.

[21] Appl. No.: 162,994

[22] Filed: Jun. 25, 1980

[51] Int. Cl.[3] ..... B41J 9/38

[52] U.S. Cl. ..... 101/93.01; 101/93.14; 101/93.29; 340/515; 324/73 R; 324/415; 371/28

[58] Field of Search .... 101/93.01, 93.14, 93.29–93.34, 101/93.48; 340/514, 515, 516; 364/550; 324/421–424, 73 R, 415; 371/24, 25, 29

[56] References Cited

U.S. PATENT DOCUMENTS

| | | | |
|---|---|---|---|
| 3,814,920 | 6/1974 | Huelkers | 371/25 |
| 4,070,565 | 1/1978 | Borrelli | 324/73 R X |
| 4,139,147 | 2/1979 | Franke | 371/25 |
| 4,216,374 | 8/1980 | Lam et al. | 324/73 R X |
| 4,216,539 | 8/1980 | Raymond et al. | 324/73 R X |
| 4,275,653 | 6/1981 | Bolcavage | 101/93.14 |
| 4,278,021 | 7/1981 | Nahano et al. | 101/93.14 X |

*Primary Examiner*—Edward M. Coven
*Attorney, Agent, or Firm*—John S. Gasper

[57] ABSTRACT

A method and apparatus for testing print elements of a printer, such as a belt printer, in which the print element operating circuits are energized at an energy level insufficient to cause printing but sufficient to generate feedback signals for checking operativeness by a microprocessor.

21 Claims, 11 Drawing Figures

CONTROL SYSTEM AND METHOD FOR TESTING PRINT HAMMERS IN A HIGH SPEED PRINTER

This invention relates to printing and particularly to a control system and method for testing print hammers in a high speed printer.

The following co-pending applications are cross-referenced.

1. Application of R. D. Bolcavage, A. J. Ferraro and A. E. Fleek entitled "Printer System Parity Checking of Print Hammers Using Software Control", Ser. No. 115,841, filed on Jan. 28, 1980.

2. Application of R. D. Bolcavage, A. J. Ferraro and A. E. Fleek entitled "Belt Printer Control Architecture", Ser. No. 115,856, filed on Jan. 28, 1980, now U.S. Pat. No. 4,273,041, issued June 16, 1981.

High speed printers of the type in which this invention is most useful generally comprise a plurality of uniformly spaced print hammers arranged in a row parallel with a continually moving type carrier such as a flexible character belt, band, chain, train or a rotating drum or the like. A control system which may include an electronic data processor such as a microprocessor selectively operates the print hammers in random fashion to record lines of characters on a record medium which is then incremented one or more line spaces at the completion of printing of a line of characters. In printers using a flexible type belt, etc. the pitch of the characters and hammers is different so that characters align with the hammers in accordance with the well known sub-scan principle of operation. The control system in turn options the hammers for firing in sequences which correspond with the sub-scan alignment sequences. The means for operating the print hammers are for example, electromagnetic actuators including a coil energized by an operating circuit. The control means selectively turns on the operating circuits for a fixed duration usually over a time interval of several sub-scans which results in the selected hammer impacting a print medium and a selected character.

The operativeness of each print hammer, i.e. the operating means including coil, operating and selection circuits, needs to be tested periodically. Appropriate times for testing the hammers could be after power-on and before printing of the desired output data is to occur. It may also be desirable to test hammers on request during the period of use of the printer without turning off the printer for this particular purpose. Such tests may also be performed on request by an operator or maintenance person. Heretofore such testing involved actual printing of one character at a time at each of the print positions. There are many occasions during the utilization of such printers as output devices for data processing systems when the printing of test patterns is not desirable or even possible after the printing system is brought on line.

This invention involves a method and control system for operating a high speed line printer in which hammer testing is done by actual firing of the print hammers but without actual printing of characters. The invention is further practiced without need for disabling or dismantling the printer apparatus or without special equipment. Furthermore in the control system in which the invention is practiced a processor means such as a microprocessor is easily programmed for practicing the invention.

Basically the invention involves a method and control system where firing each print hammer occurs one at a time for only a fraction of the normal duration. Specifically each hammer operating circuit is activated to energize the operating coils or other means which drive the hammer for a duration that is not long enough for the hammers to actually strike the paper. In the preferred embodiment, the method and control system includes a microprocessor having a microprogram for activating hammer selection driver circuits and the operating coils for a duration which is too short for the hammer to strike the paper and characters but long enough to activate a feed-back circuit. The signals from the feed-back circuit are then checked by the microprogram and stored or displayed for purposes of later indicating what operating errors if any have occurred. In the preferred embodiment of the invention the print hammers are optioned in successive option intervals in a fixed sequence in accordance with a series of sub-scan alignment sequences. For printing, hammers selected to print are activated at a first time in the option intervals of said sequence. For testing, the print hammers are activated at a second time in said option intervals whereby the hammer operating circuits are energized shortly before the optioning circuits are deactivated. In the preferred embodiment of the invention the optioning of the print hammers is performed by a fire tier generator and the testing of the hammers is performed in a test sequence which is under control of a microprocessor.

With this arrangement testing of print hammers can be accomplished at any time at the beginning or during the on line operation of the printer. Since no actual printing occurs no extraneous print matter appears on the print medium and no wasted print medium is involved. The method and control system provides simple, efficient and rapid means for testing print hammers in high speed printers. Other advantages will be readily understood by the following additional descriptive material.

The preferred embodiment of the invention is described in detail with reference to the accompanying drawings in which FIG. 1 is a schematic diagram of a printer system for practicing the invention.

Figure 1:
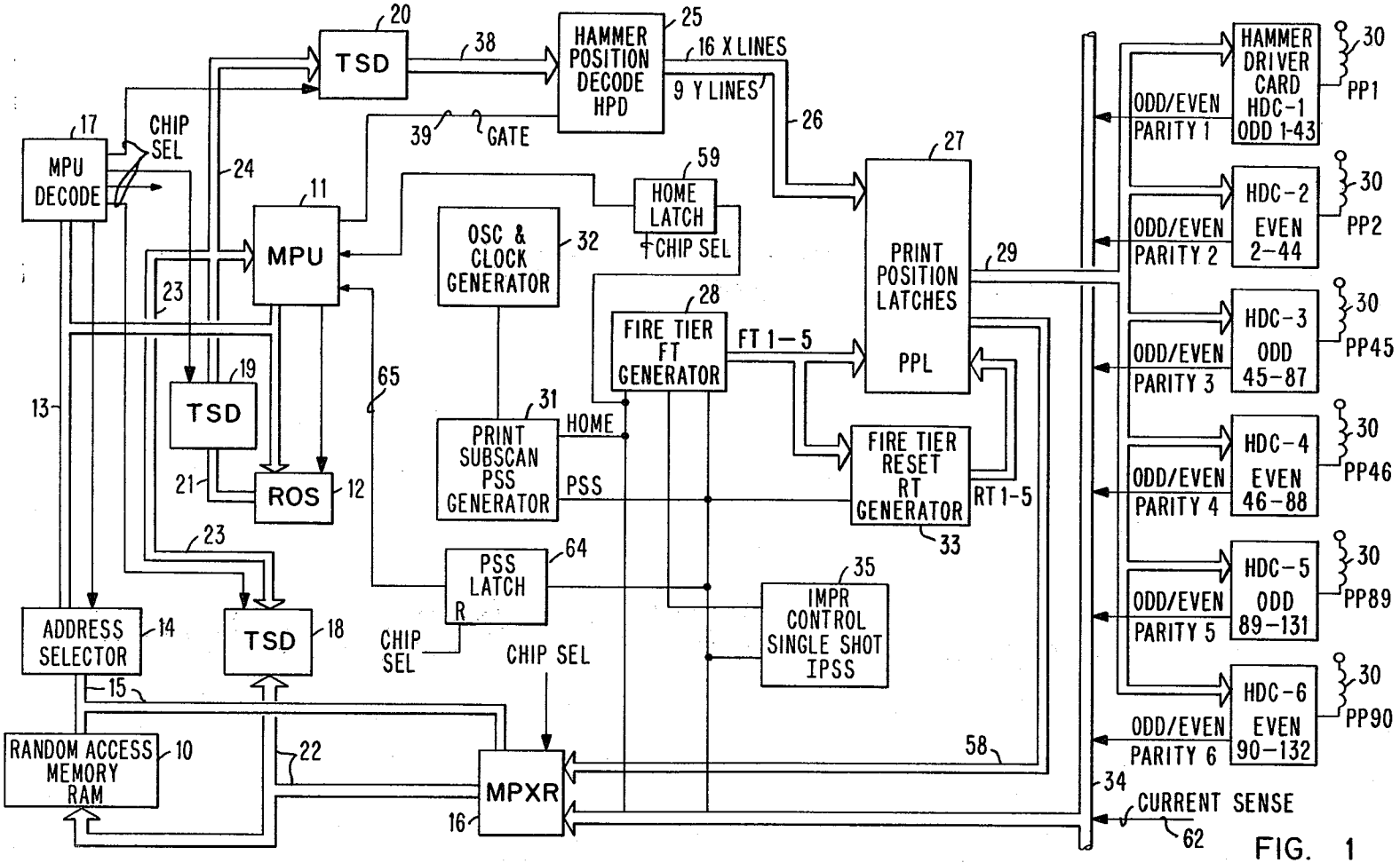

FIG. 1 shows a printer system which controls the printing operations of a belt type printer mechanism. As described more fully in the cross-referenced application number 2 of R. D. Bolcavage, et al, the printer mechanism includes a row of print hammers and a revolving type belt or similar linear type carrier by which characters are movable continuously past the print hammers. Because of differences in the pitch of the print hammers and the characters, printing occurs on the basis of scans and sub-scans in which various groups of characters are aligned/optioned to various groups of hammers which are selectively operated to record characters on a print medium. The subscan alignment sequences are repetitive throughout the printing cycle which could include one or more lines of data printed in succession at high printing rates.

Also, as described in more detail in the above mentioned cross-referenced application, lines of data stored in a random access memory RAM 10 are rearranged therein into a printing algorithm by a microprocessing unit MPU 11 in accordance with suitable microprogramming contained in a read-only storage ROS 12. The printing algorithm includes various tables including a sub-scan table SST and a print position fire table PPFT the latter of which contains the print position fire data organized in sub-scan order to be used by MPU 11 for controlling the operation of the print hammers optioned with characters in the sub-scan sequences. As described in cross-referenced application 1, expected parity is also stored in the PPFT with the sub-scan fire data. More particularly, MPU 11 calculates the expected parity during the building of the print position fire table. Specifically, each print position added to the print position fire table in a sub-scan results in MPU 11 calculating and recalculating the expected parity for that sub-scan and storing it in the storage location following the last position in the print position fire table.

Address connections for MPU 11 to ROS 12 and RAM 10 comprise Address Bus 13, Address Selector 14 and Address Bus 15. Address Bus 15 also connects Address Selector 14 to a print status multiplexor MPXR 16. Address Bus 13 is further connected to MPU decode 17 which generates various gating CHIP SEL signals to Tri-State devices TSD 18, 19 and 20 as well as to MPXR 16. Data used by MPU 11 for building the printing algorithm tables and for controlling print hammer operation as well as for parity calculation and checking flows from ROS 12 on Data Bus 21 through TSD 19 and from RAM 10 and MPXR 16 on DATA Bus 22 through TSD 18 and bus 23 to MPU 11 and on Data Bus 24 to TSD 20 from MPU 11. The operation of MPU 11 which corresponds with MPU 2 in the above-mentioned cross-referenced application number 2 is more fully described therein.

To print a line of data, MPU 11 addresses the sub-scan locations in the sub-scan table in RAM 10 which contain an indirect address pointing to an address in the PPFT where a print position count followed by one or more bytes of fire data for the print positions corresponding to the print hammers to be fired as well as the expected parity for that corresponding sub-scan. The fire data which in the preferred embodiment is an 8-bit byte per print position is sent by MPU 11 on bus 24 through TSD 20 to the input of a hammer position decode HPD 25. HDP 25 converts the 8-bit print position fire data into a 16X and 9Y code which is sent by a gating pulse on line 39 from MPU 11 onto bus 26 to the print position latches PPL 27. Individual latches in PPL 27 when set by an X and Y address signal on bus 26 gate hammer option fire tier pulses −TF1–5 from fire tier generator 28 over the lines of bus 29 and into the branches to various selected hammer operating circuits on hammer driver cards HDC 1–6 which energize coils 30 designed for operating individual print hammers as designated by the print position fire data taken from RAM 10. Print sub-scan PSS generator 31 driven by oscillator, and clock generator 32 and timing marks on the type belt provides print sub-scan PSS pulses to the fire tier generator 28 to produce the hammer option fire tier pulses −FT1–5 and to fire tier reset generator 33 which applies reset pulses RT1–5 to PPL 27 (see FIG. 7). PSS pulses are also supplied to MPU 11 for timing the printing and other operations as described in the above-mentioned application number 2 of Bolcavage, et al. PSS pulses are also applied to PSS latch 64 which is connected via lead 65 to MPU 11. Each PSS pulse switches PSS latch 64 generating level 1 interrupt signal to MPU 11 of the hammer test procedure to be described later. PSS latch 64 in turn is reset by a CHIP SEL signal from MPU Decode 17 on command from MPU 11. Print sub-scan PSS generator 31 generates a Home pulse to FT generator 28, MPXR 16 for various control functions as well as to Home latch 59 which in turn generates a Home pulse level 3 interrupt to MPU 11. Home latch 59 is reset by MPU 11 through a CHIP SEL pulse.

Each hammer driver card HDC 1–6 contains twenty-two hammer operating circuits designated ODD or EVEN each connected through bus 63 to a common current sense circuit 61 (see FIG. 6) and contactor 60 to a power supply +V for energizing, when selected, a corresponding number of odd or even numbered hammer operating coils 30. For example: HDC-1 contains twenty-two driver circuits for the coils 30 connected through current sense circuit 61 to hammers at the odd-numbered print positions 1–43. HDC-2 contains a like number of driver circuits connected through current sense circuit 61 for coils 30 of the even-numbered print positions 2–44, and so on, as shown in FIG. 1. The HDC's contain parity circuits associated with the hammer operating circuits and are designed to supply the six ODD/EVEN PARITY 1–6 signals on the feedback connections shown in FIG. 1 to MPXR 16 via bus 34. Each card HDC contains a parity return signal indicating whether the real time actuated driver circuits contain an EVEN or ODD count. The six ODD/EVEN PARITY 1–6 signals are constantly present on the bus 34 and constitute an actual parity AP byte to be gated through MPXR 16 and TSD 18 by MPU 11 for the purposes of performing a checking of the hammer operating circuits in the manner to be described hereinafter.

Basic Timing

Before proceeding with further description of the printer control system the basic timing is described.

Figure 7:
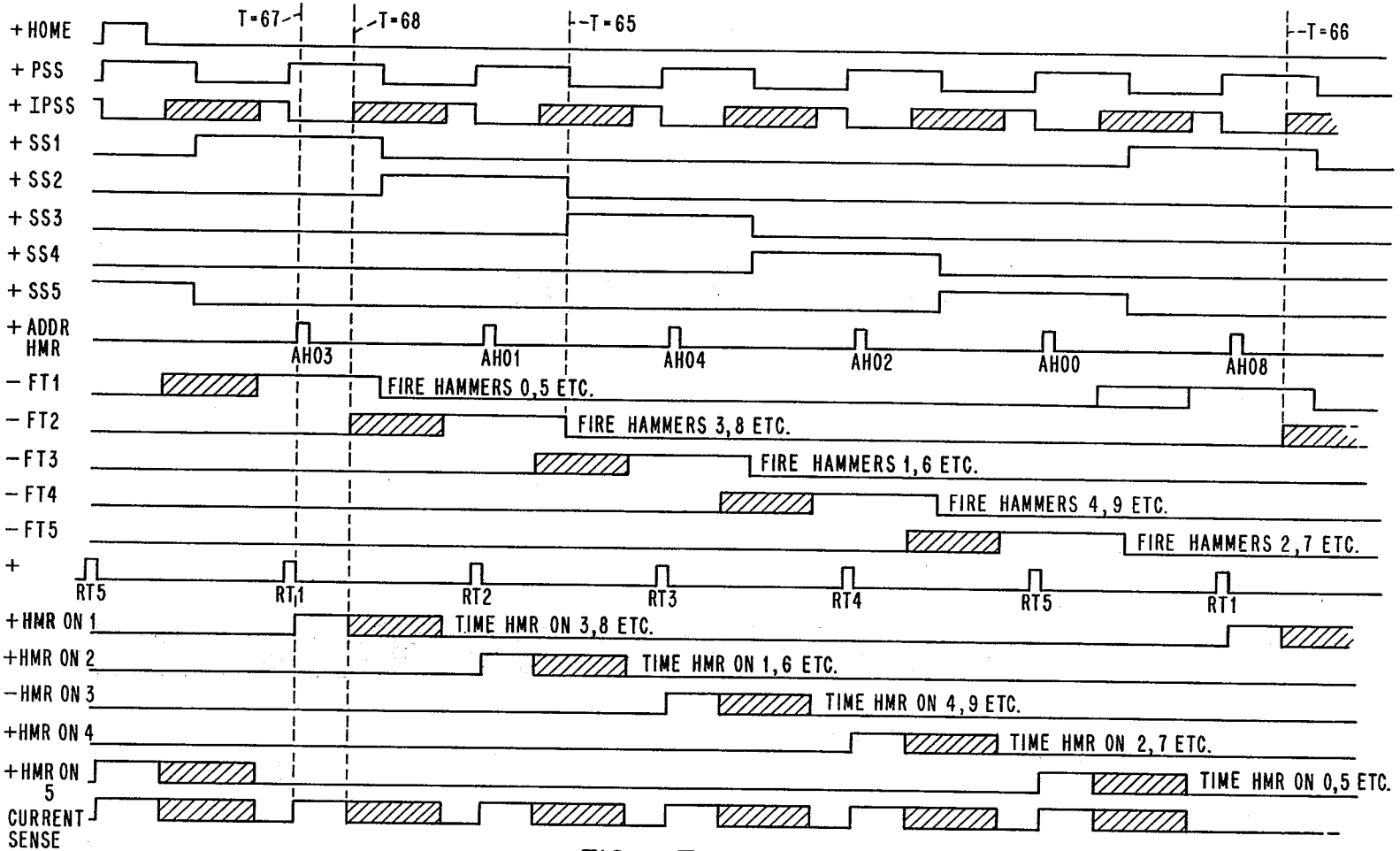
FIG. 7 is a timing chart showing the various signals for controlling the print hammer elements in printing and testing modes of operation.

In FIG. 7 the PSS pulses from the PSS generator 31 which in turn are synchronized by the timing marks on the type belt provide the basic timing for the FT generator 28 and RT generator 33 and for MPU 11 as previously mentioned. Sub-scan intervals are designated +SS1–5 and correspond in length to a PSS cycle beginning with the trailing edge of the PSS pulses.

The fire tier pulses are designated −FT1–5. The number associated with the −FT1–5 pulses indicate the hammer positions optioned during the related fire tier time interval. Fire tier pulses measure the length of time hammer operating circuits are optioned to be energized if selected in the preceding sub-scan. For example: when −FT1 is turned on by the trailing edge of a PSS pulse for the hammers selected during +SS1, turn on occurs at the end of +SS1 and the beginning of +SS2, and so on. Fire tier pulses −FT1–5 are timed out by the FT generator 28 between three and one-half to four and one-half sub-scans later, actual hammer impacting occurring near the end of that interval. FT generator 28 performs the time out by counting the prescribed number of leading edges of the PSS pulses beginning with the first leading edge after the fire tier pulse is turned on. The actual on time of the fire tier pulses is a variable and is designed to be adjustable by setting of an impression control single shot IPSS 35 in accordance with the number of layers of the print medium. The cross-hatching in the IPSS signal and the −FT 1–5 signals represents the range of adjustment. Parity checking always occurs outside this range. Fire tier reset signals RT 1–5 are very short duration pulses, for example in the neighborhood of three microseconds, initiated by the leading edge of PSS pulses and serve to reset the print position latches in PPL 27 selected by HPD 25 for the corresponding fire tier. For example: RT 5 resets print position latches in PPL 27 after −FT 5 has gone OFF. Each reset pulse +RT 1–5 is repeated by the RT generator 33 every fifth sub-scan.

Other components of the printer control system of FIG. 1 are described as follows:

Hammer Position Decode

Figure 2:
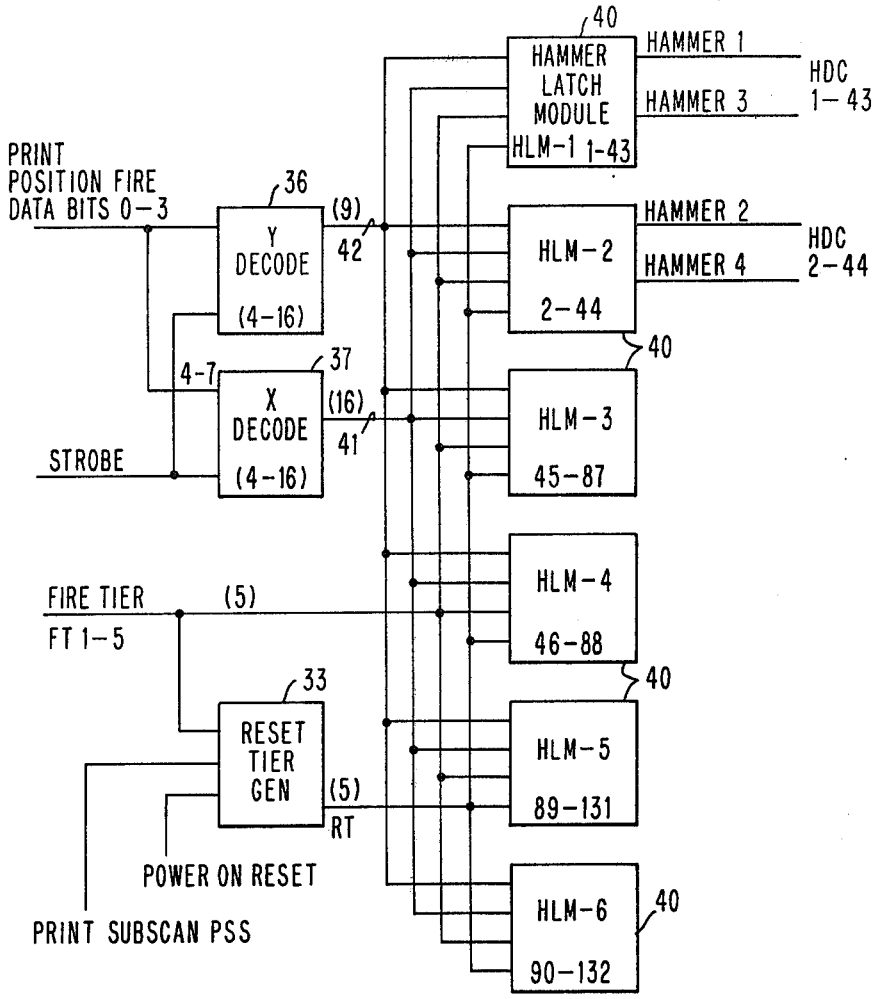
FIG. 2 is a schematic diagram showing the hammer position decode and print position latches with the fire tier reset generator portion of FIG. 1.
Figure 3:
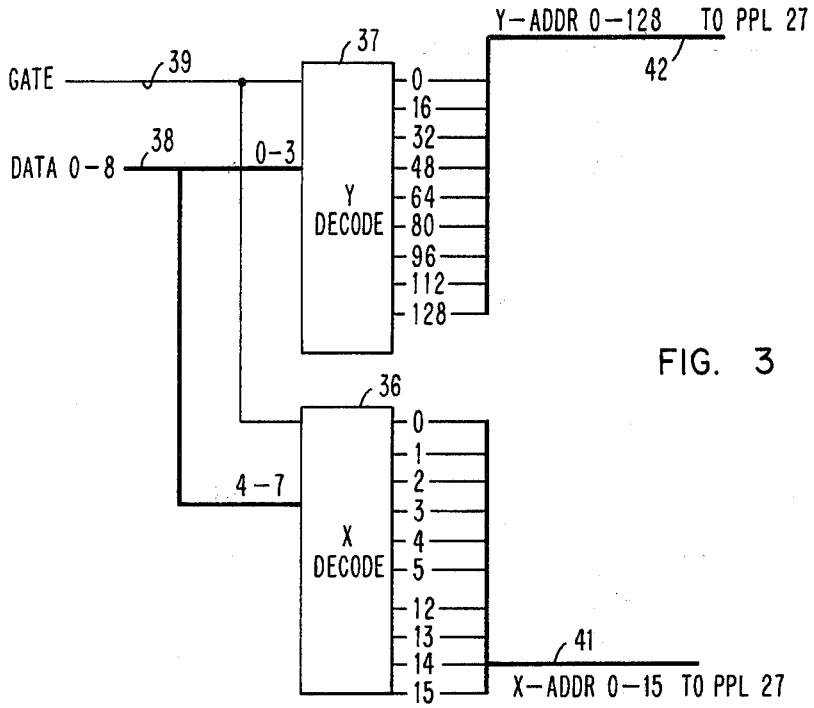
FIG. 3 is the schematic of the hammer position decode portion of FIG. 1.

As shown in FIGS. 2 and 3 the hammer position decode HPD 25 comprises X and Y decode circuits 36 and 37 which are conventional 4 to 16 bit decoders. Four data bits (4–7) from the 8-bit print position fire data byte on bus 38 from TSD 20 are decoded by the X decode 36 for bringing up one of 16X address lines 41 which are part of bus 26 in FIG. 1. The X address lines 41 are designated by the successive numbers 0–15. Four bits (0–3) of the print position data byte on bus 38 are decoded by a Y decode 37 for activating one of 9 (out of a possible of 16) Y address lines 42 of bus 26 in FIG. 1. The Y address lines 42 are designated in succession by the numbers 0–128. A GATE signal on line 39 from MPU 11 sends the selection pulses on the decoded X and Y address lines 41 and 42 connected to print position modules 40 via busses 42 and 41 of bus 26.

Latches in PPL 26 are selected by combination of decoded signals on lines 41 and 42. Details for the specific combination for connecting and selecting a particular latch on the modules 40 of HPD 25 may be further understood from cross-referenced application number 2.

Print Position Latches PPL 27

PPL 27 for the illustrated embodiment comprises 132 latches corresponding to 132 print hammers (designated 0–131) arranged in suitable configuration, each latch being connected to the combination of an X and Y address line from bus 26 as described plus further connections to the FT generator 28 and RT generator 33. FIG. 2 shows the circuit configuration in which print position latches are grouped in modules 40 in an ODD/EVEN arrangement corresponding with the ODD/EVEN arrangement of the hammer driver cards HDC 1–6. Lines 41 and 42 comprise the sixteen (16) and nine (9) X and Y address lines of bus 26 as previously described.

Figure 5:
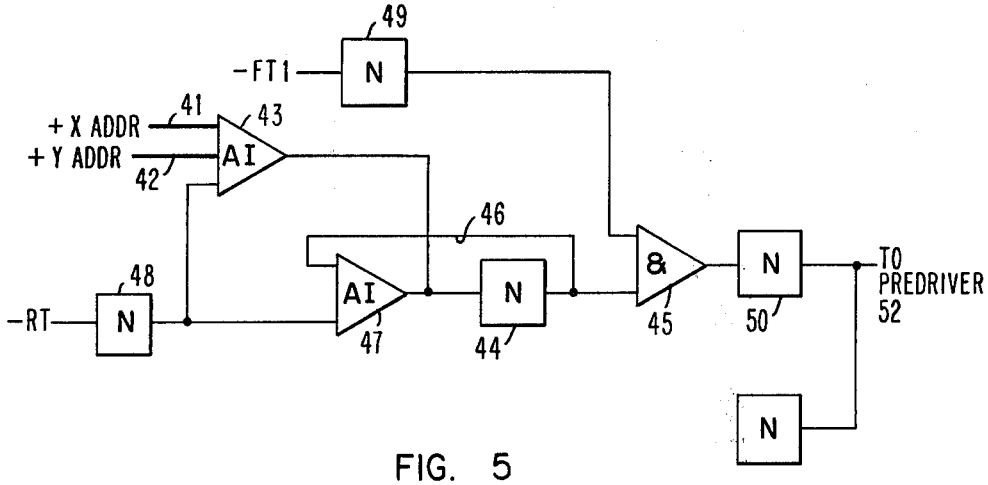
FIG. 5 is a detailed circuit of one of the print position latches of FIG. 1.
Figure 4:
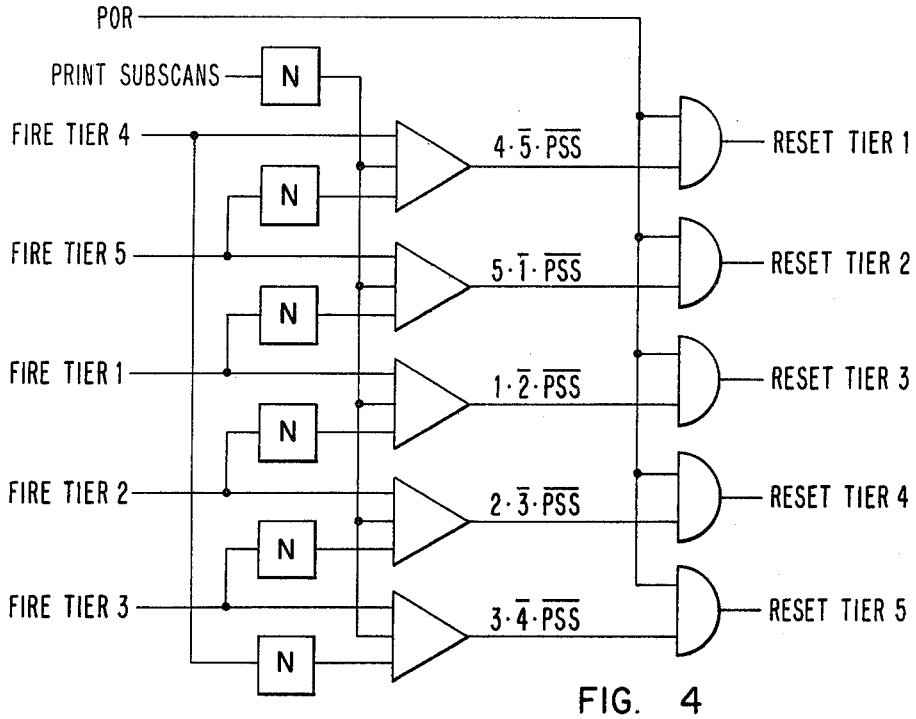
FIG. 4 is a detail logic circuit diagram of the fire tier reset generator portion of FIG. 2.

In the detailed schematic of the latch circuit of FIG. 5, selection signals for the X and Y address on lines 41 and 42 to AND INVERT circuit AI 43 during $\overline{RT}$ time cause a gating signal to be applied through inverter 44 to AND circuit 45. The gating signal is supplied also on the feedback connection 46 to the input of AND INVERT circuit AI 47. This sets the latch and holds the gating signal at AND gate 45 until reset by an RT signal through inverter 48 and AI circuits 43 and 47. Fire tier signals −FT 1–5 through inverter 49 are GATED through AND circuit 45 and inverter 50 to the input of a predriver circuit which is part of the hammer operating circuits of HDC 1–6. For example: for print position PP 88 to be selected, as illustrated in FIG. 3, the signals on lines 41 and 42 to AI circuit 43 would be X 8 from X decoder 36 and Y 80 from Y decoder 37. This combination sets the latch for gating the fire tier signal −FT 2 through AND gate 45 and inverter 50 to the predriver circuit for print position 89 on the hammer driver card HDC-5. Further details of the decoding for other print positions can be obtained by reference to co-pending cross-referenced application 1.

Figure 6:
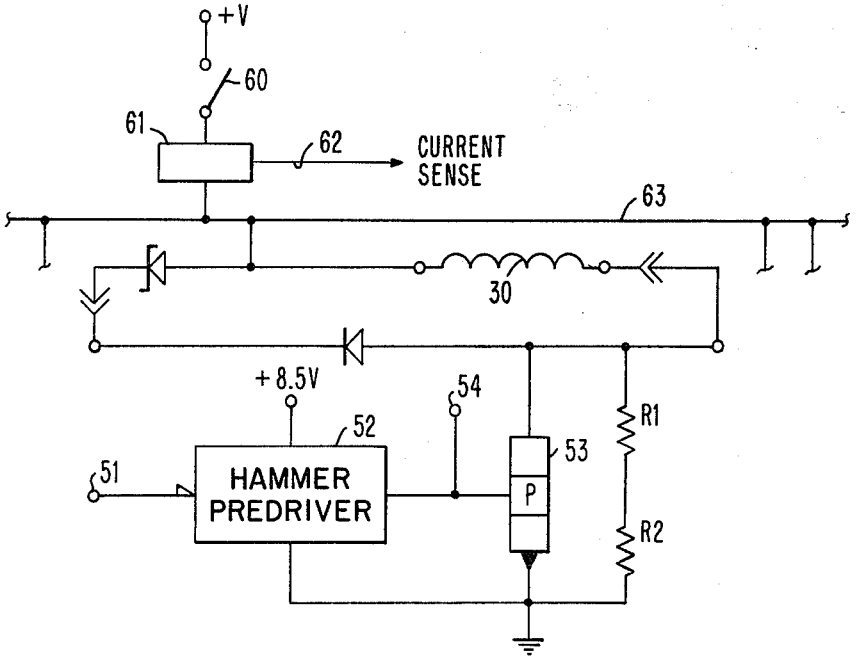
FIG. 6 shows the current sense circuit in combination with the circuitry for operating the hammer drive coils of FIG. 1.

FIG. 6 is a schematic circuit showing a hammer operating circuit usable for energizing one of the coils 30 of an individual print hammer. The input 51 of hammer predriver 52 is connected to inverter 50 of FIG. 5 for activation as previously described. The output of predriver 52 is connected to the base of transistor 53 of a driver circuit which includes resistors R 1 and R 2. When turned on by a fire tier signal to predriver 52, with power on contactor 60 closed, transistor 53 draws current from the +32 V power supply through current sense circuit 61 through hammer coil 30 to ground. Terminal 54 is a connection point for the feedback to the parity circuits. Lead 62 from current sense circuit 61 provides a CURRENT SENSE voltage signal through bus 34 (see FIG. 1) to multiplexer MPXR 16 (see FIG. 1) where it can be monitored by the testing routine of MPU 11 to be described. Current sense circuit 61 is connected via line 63 in common to all hammer coils 30. This is possible since hammers are tested one at a time so that the presence of a CURRENT SENSE voltage signal can be directly correlated with the hammer being tested.

Parity Checking

In preparation for printing MPU 11 precalculates an expected parity for those subscans in which print position fire data is generated for hammer operating circuits to be activated in a sub-scan. This is done preferably in the course of building the print position fire table PPFT in accordance with micro programming contained in ROS 12 and operable as described in detail in the cross-referenced applications. Expected parity is computed and stored or updated and stored by MPU 11 in the last table address each time print position fire data is added to the print position fire table. For the purpose of computing expected parity a look up table is provided in ROS 12 which identifies numbers of the HDC for each print position. In the specific embodiment of the look up table, each print position is identified by one of six numbers (in the hex code 01, 02, 04, 08, 10, 20) based on the ODD/EVEN arrangement of the operating circuits on HDC 1–6. For example: print position PP 2 has a hex table number 02 (For HDC-2) while PP 47 has the hex table number 04 (for HDC-3). Thus, in computing expected parity during the building of the print position fire table in which both print position fire data is to be provided for PP 2 and PP 47, MPU 11 exclusive OR's the table number for PP 47 with the expected parity for print PP 2. The result of the exclusive OR process would be an ODD/EVEN expected parity 06 which is stored in the last address position of the print position fire table. In this way parity checking as described hereafter relates to the hammer driver cards which are field replacable units.

Figure 11:
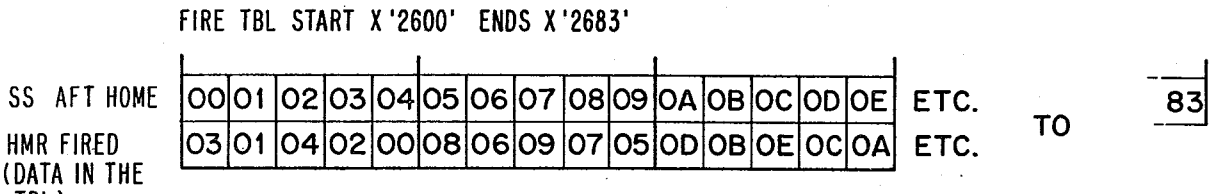
FIG. 11 is a chart illustrating a fire table used for activating the operating circuits of the print hammers in accordance with the test method of the invention.

As previously described, MPU 11 during the course of controlling the printing operations also performs parity checking of the hammer operating circuits and specifically the predriver circuits. This is done each sub-scan interval during a check parity valid window time when all operating circuits are in stable conditon, i.e. no circuits are being turned ON or OFF (e.g. T0, T3, T6, T9, T12, T15 in FIG. 7 of co-pending application 1). Basically, parity checking is performed by MPU 11 calculating a composite parity for each sub-scan and comparing it with the actual parity for a particular sub-scan as presented by the parity checking circuits of the hammer driver cards HDC 1–6 on bus 34 to MPXR 16. For parity checking MPU 11, or alternatively RAM 10, has a plurality of registers for storing the various parity bytes used in the computation and in the comparing operations. As seen in FIG. 11 of copending cross-referenced application 1 registers A, B, C and D provide storage for the expected parity bytes from the last four sub-scans. NP register contains the new expected parity byte from the PPFT in RAM 10. CP is the storage register for the composite parity byte calculated by MPU 11. The PFB register is the storage for the actual parity AP received from the feedback lines of bus 34 to multiplexor MPXR 16. Further details of the computation of the composite parity as part of the printing mode of operation may be understood by reference to said co-pending cross-referenced application 1.

Hammer Testing

In accordance with this invention, hammer testing is performed by MPU 11. Since the print hammer operating circuitry is activated for a shorter time duration than normally used for printing, the hammer selection sequence is changed from the normal. Also in testing the hammer firing sequence can be fixed. Whereas for printing, the firing sequence is entirely variable based on the desired characters and their print positions for the data to be printed. For the purpose of testing, a hammer fire test lookup table (see FIG. 11) is provided in ROS 12 which identifies numbers of the HDC for each print position arranged in sequence and preferably in successive storage locations. Alternatively, the fire test table may be stored in RAM 10 in which case the test table would be read into RAM as one of the start up routines which would to some extent delay the hammer test after power on. In the specific embodiment of this invention, as seen in FIG. 11, the first storage position of the hammer test table contains the address of hammer 03 then followed in succession by 01, 04, 02, 00, 08 etc. for all 132 print hammer addresses. MPU 11 is programmed to read this fire test table from ROS 12 and proceeds to send the test hammer addresses AH 03 etc. as shown in FIG. 7 to HPD 25 via bus 24 through TSD for setting the selected print position latches in PPL 27 in the same manner as previously described for activating the print hammers to actually print characters. The difference is that in the test mode MPU 11 causes the addressed hammer to be activated a short time before the hammer option pulse of FT generator 28 times out. The time interval the hammer predriver and driver are turned on is sufficient to send a CURRENT SENSE feed back pulse on line 62 (see FIG. 6) to MPXR 16 for checking by MPU 11 but too short to cause the hammer to actually impact the paper. To do this MPU 11 operates to address and set print position latches in PPL 27 for the desired print hammer coils 30 near the end of instead of at the beginning of the required fire tier option interval. In the specific embodiment of the invention as previously described, the fire tier option interval in both printing and test modes is from three and one half to four and one half sub-scans. In the case of printing, the selected hammer to be fired is addressed by MPU 11 and the print position latch in PPL 27 is set one sub-scan early. This gates the fire tier pulse to the desired hammer driver and HDC for activating the predriver 52 to energize the desired coil 30 as previously described. As described in the co-pending cross-referenced application 1, the coil remains energized for the full three and one half to four and one half sub-scans required to drive the electromagnetically operated hammer to the energy level needed to cause impact. In the case of testing (without impact), MPU 11 sends the hammer address to HPD 25 for decoding and setting the print position latch in PPL 27 for a time interval of much less than three and one half sub-scans. Referring to FIG. 7 the hammer at print position 03 would normally be addressed and its latch in PPL 27 set so that the hammer is fired at time T=65 which is the beginning of the ON time of −FT 2 and remains fired until FT generator 28 times out at T=66. For hammer testing, the print hammer at print position 03 is addressed and the latch set in PPL 27 at T=67 (see +ADDR HMR for AH03 in FIG. 7). At this point, −FT 2 is still turned on (i.e. has not timed out) from its previous hammer option cycle thereby causing the driver circuit on HDC-2 to energize coil 30 at print position 03 causing current sense circuit 60 to send a CURRENT SENSE signal on line 62 to MPXR 16. A feedback signal is also sent by hammer predriver 52 via terminal 54 to the parity circuits and remains up until the predriver is shut off. This occurs a short time later at T=68 (or later within the cross-hatched area) when −FT 2 times out. At this point (T=68) hammer predriver 52 is turned off, current ceases in coil 30 and the CURRENT SENSE signal drops. Because of the short time duration of +HMR 1, the print hammer driven by the energized coil 30 will not have sufficient energy to move to the point of impact and remains essentially in its non-print position.

In the same manner MPU 11 then addresses the fire test table in ROS 12 at print position 01. (see FIG. 11) −FT 3 is then ON causing coil 30 for 01 to be energized (+HMR ON2) to generate a CURRENT SENSE which is detected and stored. The cycle is repeated until all print hammer drivers are tested for all print positions.

Figure 10:
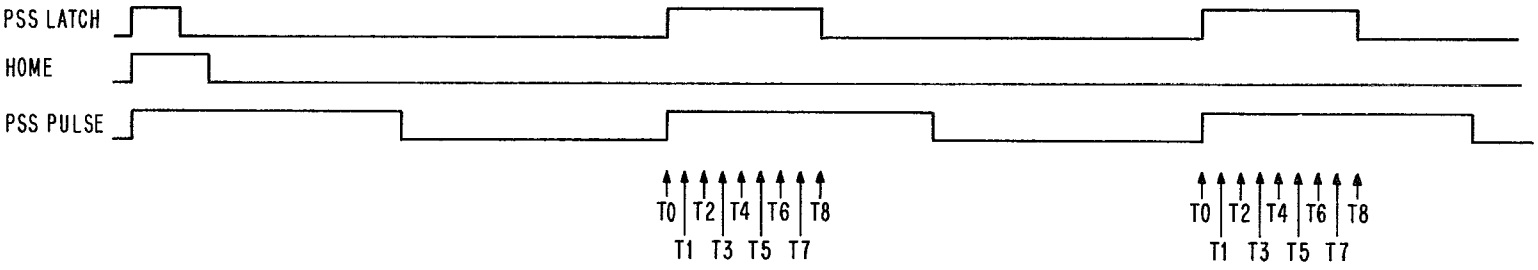
FIG. 10 is a timing chart showing the timing of the microprocessor test routine in relation to the print sub-scan pulses of FIG. 7.

FIG. 10 shows the timing of a specific MPU 11 routine useable for performing the hammer test process just described. Beginning at the first PSS pulse interrupt occuring after a HOME pulse, MPU 11 is programmed to operate in accordance with the following table at the times indicated.

T0—PSW Level 1 swap
T1—Read Driver Parity

T2—Read Latch Parity
T3—Fire Hammer
T4—Read Driver Parity
T5—Read Latch Parity
T6—Read CURRENT PSM Byte 3
T7—Data Analysis
T8—Reset PSS Latch 64

Figure 8:
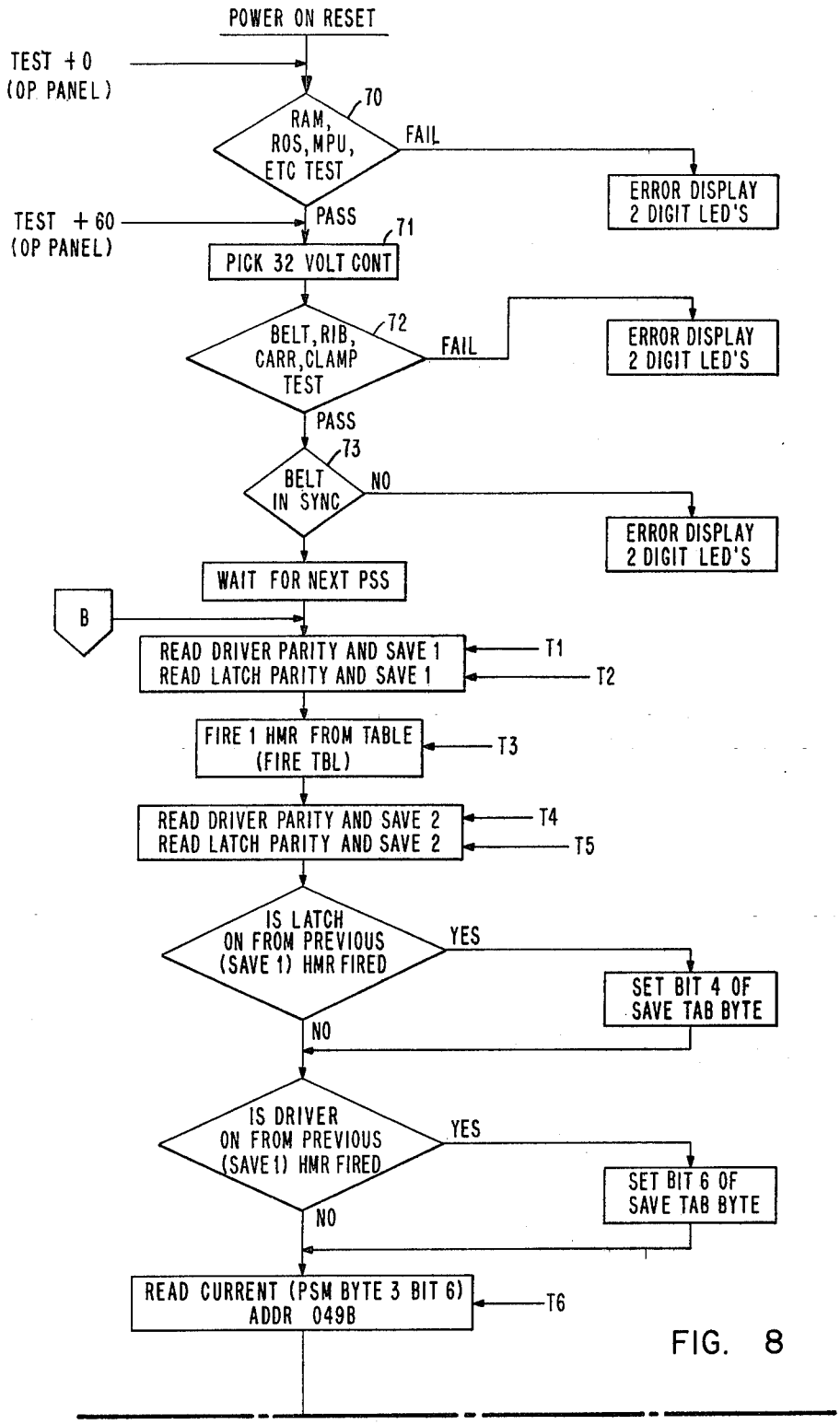
FIGS. 8 and 9 are in combination a flow chart which illustrates the method of operation of the control system for testing the print hammers operating circuits shown in the other figures.
Figure 9:
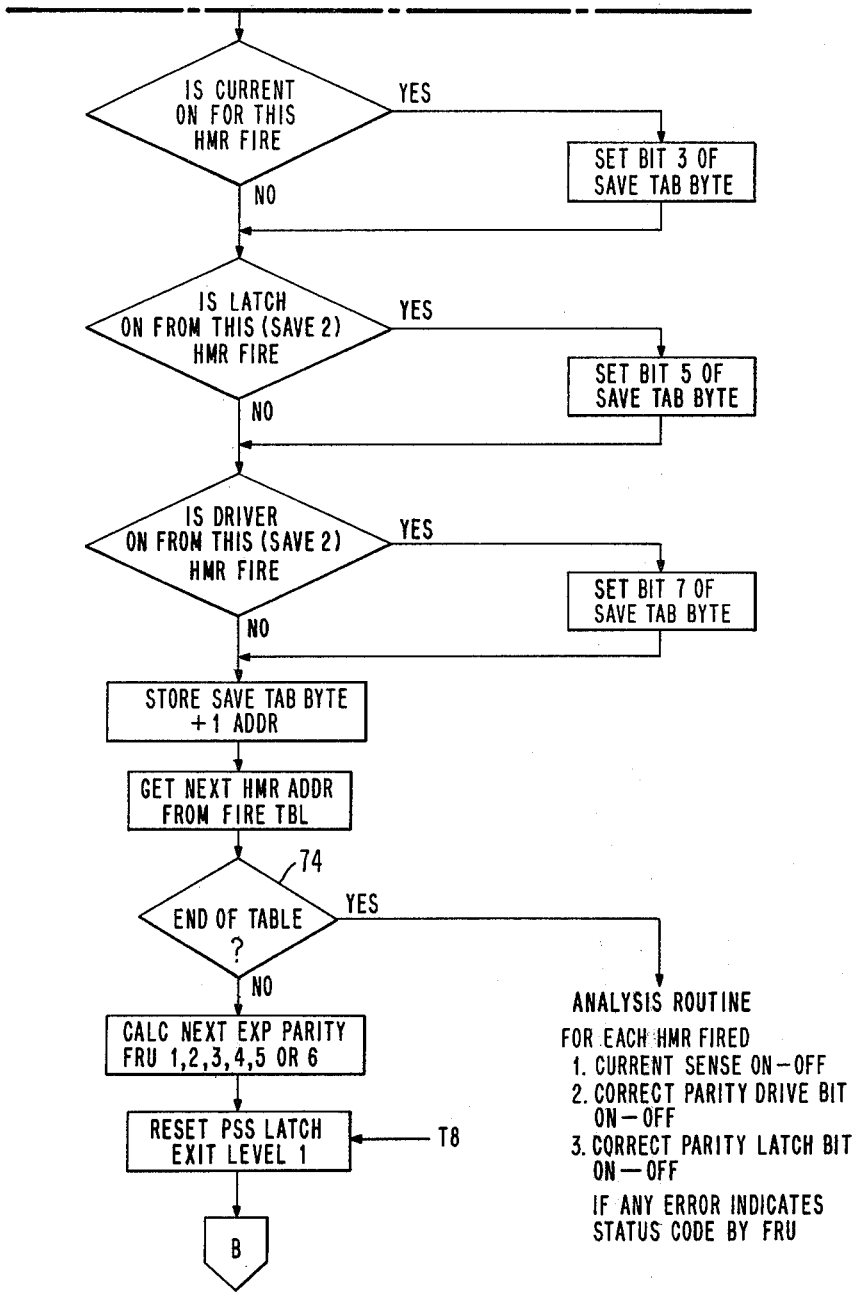

Referring also to FIGS. 8 and 9 the operating routine of MPU 11 is as follows:

At T0, MPU 11 upon receipt of a PSS pulse from the PSS latch 64 performs a PSW level SWAP and proceeds with the next series of operations.

AT T1, MPU 11 reads the driver parity byte on bus 34 at MPXR 16 and stores the result in one of its own working registers or alternatively in RAM 10. In all instances the driver parity byte should be 0 at this stage of the routine since no hammers should have been fired at the beginning of the test or they should have already timed out.

At T2, MPU 11 reads the latch parity byte on bus 58 to MPXR 16 from PPL 27 and stores the result in one of its working registers. This latch parity byte should correspond with the driver parity byte and should be all 0's having been reset by the RT generator 33 if any previous hammers have been fired and timed out.

At T3 corresponding with T=67 in FIG. 7, MPU 11 fires the selected print hammer by sending the hammer address from the fire test table to HPD 25 which sets a latch in PPL 27 and turns on one of the hammer drivers.

At T4 MPU 11 reads the driver parity byte on bus 34 at MPXR 16 and stores the result in a third working register. This is then followed at T5 by a reading of the latch parity byte and storing the result.

At T6 MPU 11 then reads the CURRENT SENSE bit of the PSM byte on bus 34 at MPXR 16 and stores the result in a further working register.

At T7 MPU 11 processes all the data stored in the working registers in steps T1, T2, T4, T5 and T6 as shown in FIG. 9 and places a calculated byte in a save table in RAM 10 for the related hammer address position for subsequent analysis of the print hammer operation.

AT T8 MPU 11 generates A CHIP SEL signal to reset PSS latch 64. MPU 11 then returns to other processing until the next PSS pulse produces a PSW 1 level interrupt from PSS latch 64. The procedure for T0–T8 as described is then repeated for the next and all successive hammer address positions in the hammer test table as shown in FIG. 10.

The following is the structure of an analysis byte usable in accordance with this invention.

Bit 7—fired driver on
Bit 6—previous set latch on
Bit 5—set latch on
Bit 4—previous fired driver on
Bit 3—current on
Bit 2—multi fire error
Bit 1—
Bit 0—

The following is an explanation of the meaning of each of the Bits.

Bit 7 is set in the related hammer address in the save table portion of RAM 10 for a valid driver parity check at T4. See FIG. 9.

Bit 6 is set in the related hammer address of the save table in response to the reading of the latch parity byte at T2 where the result of the reading of the latch parity byte shows that a latch has been set. This represents an error condition which could then be corrected through operator action either immediately or at some subsequent test period.

Bit 5 is set as a result of a reading of the latch parity byte at T4.

Bit 4 is set if the read latch parity byte at T2 shows a latch set in PPL 27.

Bit 3 is the bit set if the current set signal is present on line 62 at T3.

Bit 2 is set if more then one error condition is found in the analysis performed by MPU 11 at T6.

Bits 1 and 0 are extraneous bits not usable as part of the hammer test procedure.

A further detailed description of the hammer testing procedure and its relation to the start up and control of the printer is shown in FIGS. 8 and 9.

POWER ON RESET—this is the beginning of the control system operation. This may occur when a manual switch is operated turning on the power supply circuit which supplies power to the control system and various operating elements in circuits of the printer mechanism.

Decision block 70 refers to initial testing in which the MPU's perform self-testing as well as testing of ROS 12 and RAM 10 in preparation for further initial and hammer testing.

If the results of the test of block 70 result in a PASS condition the MPU's then proceed to block 71 in which MPU 11 sets a signal which picks contactor 60 (see FIG. 6) thereby applying power to the current sense circuit 61 to bus 63 to the hammer drive coils 30 as shown in FIG. 6. At this point MPU 11 may perform a check of the CURRENT SENSE line 62. If a CURRENT SENSE signal is present MPU 11 aborts the initializing procedure, sets an error indication in the display, and shuts off the power. If no CURRENT SENSE signal is present on line 62 the MPU's proceed with testing of the belt drive, the ribbon drive, carriage drive and paper clamp as shown in block 72. If these tests are PASS MPU 11 proceeds with the BELT IN CYNC check shown in block 73. If a YES result is produced from the test in block 73 MPU 11 then begins the print hammer test upon the occurrence of the first PSS pulse after the home leading edge occurs as shown in FIG. 10. MPU 11 then proceeds at the next PSS pulse interrupt as shown in FIGS. 8 and 9 to perform the print hammer test as described in connection with T0–T8. As shown in FIG. 9 the reset of the PSS latch at T8 exits to a level 1 signal and a branch routine back to the beginning of the next PSS pulse as shown in FIG. 8. At the end of the hammer address for the last hammer position in the hammer fire test table an END OF TABLE test in block 74 produces a YES branch to the analysis routine. All the data stored in the save table is then processed as indicated in FIG. 9 to determine the indication of any error for any hammer fire. In the event there are no errors indicated in the save table MPU 11 then proceeds to the print mode to process lines of data to be printed as described in the co-pending cross-referenced applications. In this mode MPU 11 selects hammers at the beginning of the fire tier pulses.

As seen in FIG. 8 the hammer test procedure may be invoked on request by an operator. This is shown by the TEST +0 and TEST +60 entry points and may be entered from the OP panel. These entries could be made for example when it is desired to verify the results of the earlier tests conducted automatically by POWER ON RESET.

Thus it will be seen that a method and control system are provided for testing hammers in a high speed line printer which does not require actual printing but in which the hammer operating elements are actuated and tested. While a specific implementation of the preferred embodiment has been described, the invention may be implemented in ways other than by activating the hammer driver circuits for a time too short to cause printing to occur. Also while an electromagnetic print hammer actuator is illustrated other electrically operated print hammer actuators may be utilized in practicing the invention. It is also readily observed that the invention can adapted for use in a control system in which a processor such as a microprocessor is utilized and that the processor is readily adaptable for programming or microcoding as the case may be. In addition, hammer testing is accomplished with the normal operating circuitry and no other special hardware is required.

What is claimed is:

1. A method of testing the operation of the print hammers in a row of print hammers arranged to impact a print medium with type characters on a movable type element such as belt or the like, said hammers being individually operable for printing by a control means for energizing individual electrical hammer operating circuits for a duration sufficient to cause said print hammers to cause characters to be printed on said print medium, and means for generating feedback signals indicative of the operation of said hammer operating circuits, said method comprising energizing each of said electrical operating circuits for a second duration too short to cause printing to occur on said print medium but long enough to cause generation of said feedback signals, and sensing said feedback signals to determine the operation condition of said print hammer following operation for said second duration.

2. In a line printer apparatus having a row of print elements such as print hammers or the like and a moving type carrier such as a type belt or the like co-operable with said print elements for recording characters on a print medium, operating means for said print elements, means associated with said operating means for generating feedback signals resulting from activation of said operating means, and control means for selectively actuating said operating means in a first mode in which characters are printed on said print medium and in a second mode in which characters are not printed but feedback signals are generated, said control means including means responsive to said feedback signals generated in said second mode for determining the operability of said operating means.

3. In a line printer apparatus in accordance with claim 2 in which said control means actuates said operating means in said first mode a first amount sufficient to cause printing of characters and in said second mode a second amount insufficient to cause printing but sufficient to cause feedback signals to be generated.

4. In a line printer apparatus in accordance with claim 3 in which said operating means includes coil means energizeable for actuating said print elements, and said control means includes means for selectively energizing said coil means at a first energy level for causing printing and a second energy level insufficient to cause printing but sufficient to produce generation of said feedback signals.

5. In a line printer apparatus in accordance with claim 4 and in which said control means includes means for selectively energizing said coil means for a first interval sufficient to cause printing and a second interval too short to cause printing but sufficient to cause generation of said feedback signals.

6. In a line printer apparatus in accordance with claim 5 in which said operating means further comprises driver circuits for energizing said coil means, said driver circuits being selectively operable by said control means for energizing said coil means for said first and second intervals.

7. In a line printer apparatus in accordance with claim 6 in which said driver circuits are operable for applying current to said coil means, and said feedback means includes sense circuit means for sensing current in said coil means.

8. In a line printer apparatus in accordance with claim 7 in which said sense circuit means is a single current sense circuit connected in common with a plurality of said coil means for a plurality of said print elements.

9. In a line printer apparatus in accordance with claim 7 in which said control means further includes storage means, and a microprocessor for storing information derived from said feedback signals in said storage means.

10. In a line printer apparatus in accordance with claim 9 in which said control means further includes connector means operable by said microprocessor for connecting said coil means to a power source.

11. In a line printer apparatus in accordance with claim 9 in which said storage means includes print element fire data arranged in a fire test table useable by said microprocessor in said second mode for energizing said coil means.

12. In a line printer apparatus in accordance with claim 7 in which said means for energizing said coil means for said first and second intervals comprises, signal generating means for generating a print element option signal, said option signal having a fixed option interval corresponding at least to said first interval sufficient to cause printing, means for generating a print element selection signal coincidentally with said print element option signal, means responsive to coincident selection and option signals for activating said driver circuits for energizing coils of said print elements in accordance with said print element option and selection signals, and means for selectively controlling the period of coincidence of said selection and option signals in accordance with said first and second intervals.

13. In a line printer apparatus in accordance with claim 12 in which said means for selectively controlling the period of coincidence of said selection and option signals includes means for varying the turn on time of said selection signal relative to said fixed option interval.

14. In a line printer apparatus in accordance with claim 13 in which said turn on time of said selection signal occurs for at least the duration of said fixed option interval to cause printing and for a short time just prior to end of said option interval for a duration corresponding to said second interval.

15. In a line printer apparatus in accordance with claim 12 in which said print elements and characters on said moveable carrier are arranged to be alignable in scans having a plurality of sub-scans, and said option signal generating means generates a corresponding plurality of sub-scan option signals for each scan, said sub-scan option signals having fixed option intervals extending over a plurality of sub-scans sufficient to cause printing, and said selection signals are turned on selectively in coincidence with related sub-scan option signals for said first and second intervals, said first interval corresponding to a first number of sub-scans sufficient to cause printing and for a second number of sub-scans insufficient to cause printing but sufficient to activate said means for generating said feedback signals.

16. In a line printer apparatus in accordance with claim 15 in which said plurality of sub-scans equals 5, and said first number of sub-scans sufficient to cause printing is in the range of 3.5 to 4.5.

17. In a line printer apparatus in accordance with claim 15 in which said means for generating said sub-scan option signals comprises a fire tier generator operable in synchronism with said moveable type element, and said means for generating said selection signals at different times in relation to related sub-scan option signals comprises latch means settable by said microprocessor to generate a signal for activating the driver circuits of selected print elements, and storage means containing print element selection data useable by said microprocessor for selectively setting said latch means.

18. In a line printer apparatus in accordance with claim 17 in which said print element selection data comprises print element addresses arranged in a fire table useable by said microprocessor in said second mode for setting said latch means for energizing said coil means for driving print elements corresponding to said hammer addresses in said fire table.

19. In a line printer apparatus in accordance with claim 18 in which said hammer addresses in said fire table are arranged in the sequence corresponding with print elements optioned by sub-scan option signals from said fire tier generator.

20. In a line printer apparatus in accordance with claim 15 in which the plurality of sub-scans equals 5 and said sub-scan option interval is 3.5 to 4.5 sub-scans, and said hammer selection signal has a duration of 3.5 to 4.5 sub-scans for causing printing and 0.5 to 1.5 sub-scans for activating said driver circuits for an interval insufficient to cause printing but sufficient for generating feedback signals.

21. In a printer apparatus having one or more print elements such as print hammers or the like for printing data on a print medium, operating means for said print elements, means associated with said operating means for generating feedback signals resulting from the activation of said operating means, and control means for selectively actuating said operating means in a first mode in which data is printed on said print medium and in a second mode in which data is not printed but feedback signals are generated, said control means including means responsive to said feedback signals generated in said second mode for determining the operability of said operating means.

* * * * *